US007874930B2

(12) United States Patent
Hubley

(10) Patent No.: US 7,874,930 B2
(45) Date of Patent: Jan. 25, 2011

(54) GOLF SWING TRAINING TOOL PROVIDING A DIRECT VISUAL INDICATION OF PROPER CLUB HEAD SWING PATH

(76) Inventor: Bruce Hubley, 163 Starlite Dr., San Mateo, CA (US) 94402

( * ) Notice: Subject to any disclaimer, the term of this patent is extended or adjusted under 35 U.S.C. 154(b) by 0 days.

(21) Appl. No.: 12/345,615

(22) Filed: Dec. 29, 2008

(65) Prior Publication Data

US 2009/0176595 A1 Jul. 9, 2009

Related U.S. Application Data

(60) Provisional application No. 61/009,882, filed on Jan. 3, 2008.

(51) Int. Cl.
*A63B 69/36* (2006.01)

(52) U.S. Cl. ..... 473/257; 473/218; 473/272

(58) Field of Classification Search ..... 473/218, 473/219, 257, 261, 262, 265, 266, 268, 270, 473/272, 273
See application file for complete search history.

(56) References Cited

U.S. PATENT DOCUMENTS 1,187,842 A * 6/1916 Kaas ..... 7/168
2,025,519 A 12/1935 Lingg
2,237,378 A * 4/1941 Thienemann ..... 33/501
2,652,251 A 9/1953 Molinar
2,790,642 A 4/1957 Rolfe
3,550,946 A 12/1970 Menendez et al.
3,580,584 A 5/1971 Trosko
3,920,248 A 11/1975 Medders
4,583,739 A * 4/1986 Kabbany ..... 473/218
4,871,175 A * 10/1989 Levin et al. ..... 473/218
5,077,850 A * 1/1992 Brubaker ..... 7/151
5,322,288 A * 6/1994 Amis ..... 473/272
5,398,937 A 3/1995 Regan
5,482,284 A 1/1996 Vandever
5,527,037 A 6/1996 Matsumoto
5,893,805 A 4/1999 Douglass
5,897,442 A 4/1999 Honderd
6,698,049 B2 * 3/2004 McLoudrey ..... 1/158
6,726,576 B1 4/2004 Froggatte
6,945,875 B2 9/2005 Gauer
6,949,029 B1 9/2005 Strande
7,131,910 B2 * 11/2006 Townsend, II ..... 473/278
7,238,118 B1 7/2007 Terrill

* cited by examiner

*Primary Examiner*—Nini Legesse

(57) ABSTRACT

The present golf swing training tool assists a golfer in learning the correct swing path the club head should follow during a normal golf swing, in order to consistently hit the ball in the desired direction, by providing a direct visual prompt of the proper club head swing path during each swing of the golf club. The tool may be used indoors or outdoors and is very portable.

27 Claims, 6 Drawing Sheets

GOLF SWING TRAINING TOOL PROVIDING A DIRECT VISUAL INDICATION OF PROPER CLUB HEAD SWING PATH

RELATED APPLICATION

This application is a continuation-in-part of U.S. Ser. No. 61/009,882 of the same inventor titled Golf Swing Path Alignment and Training Device, filed Jan. 3, 2008 and incorporated herein by reference.

TECHNICAL FIELD

The present invention relates to golf swing training tools.

BACKGROUND

The purpose of a golf swing training tool is to assist a golfer in learning the correct swing path the club head should follow during a normal golf swing, in order to consistently hit the ball in the desired direction.

In golf, the target line is an imaginary line drawn through the center of the golf ball to the intended target, generally the flag stick on the putting green of the hole being played.

It has been estimated that upwards of 75% of all golfers make the fundamental mistake of swinging the golf club across the target line in an outside-to-inside swing path. In other words, the swing path of the club head cuts across the ball, at an angle, toward the golfer's forward foot. This outside-to-inside swing path leads to shots that, for right-handed golfers, start to the left of the target line such that the ball, instead of being hit straight, is pulled, pull hooked, sliced, etc.

This swing path is the bane of most golfers, and has proven to be possibly the most difficult swing fault to correct.

Various golf training tools or devices are known that attempt to teach a golfer to swing the golf club so that the club head approaches the ball at a slight angle from inside the target line (on the side of the target line where the golfer is standing). Most devices require the golfer to hit the golf ball off the surface of the device.

SUMMARY

Embodiments of the present golf swing training tool assist a golfer in learning the correct swing path the club head should following during a normal golf swing, in order to consistently hit the ball in the desired direction, by providing a direct visual prompt as to the proper club head swing path during each swing of the golf club. The tool may be used indoors or outdoors and is very portable.

The golfer places the tool on the ground in any of various locations and configurations (one possible location being on the far side of the golf ball), allowing the golfer to hit shots off grass, as on a golf course, or off a driving range mat, or any desired surface, since no contact is made with the tool during the swing.

In addition, the main body of the tool forms a straight line which, when placed on the ground, is used to form a line to the golfer's intended target. This feature is very helpful in training the golfer to appreciate the importance of knowing where the target line is on each shot, and provides a visual reference for the golfer to line up to.

Further, the main body of the tool is designed to allow a swing path indicator arm to rotate 360 degrees; optionally, the swing path indicator arm may be arranged so as to allow it to slide almost its entire length, in relation to a pivot point, so that the swing path indicator arm can be placed in various useful positions to facilitate training the golfer.

In one embodiment, the main body of the tool is made up of three pieces, which can be hinged, swiveled or snapped together, or connected in any of various other well-known ways, to form the desired length required by the golfer.

The tool provides the golfer with an inexpensive, portable training tool that can be used virtually anywhere. It also provides the golfer with a golf swing training tool that gives the golfer a swing path prompt as well as visual feedback with every swing, an important feature for developing a consistently correct golf swing.

Additional features and benefits of the present invention will become apparent from the detailed description, figures and claims set forth below.

BRIEF DESCRIPTION OF THE DRAWINGS

The accompanying drawings, which are incorporated into and constitute part of this specification, illustrate one or more examples of embodiments and, together with the description of example embodiments, serve to explain the principles and implementations of the embodiments.

In the drawings.

DESCRIPTION OF EXAMPLE EMBODIMENTS

Example embodiments are described herein in the context of a golf swing training tool that provides a direct visual prompt as to proper club head swing path. Those of ordinary skill in the art will realize that the following description is illustrative only and is not intended to be in any way limiting. Other embodiments will readily suggest themselves to such skilled persons having the benefit of this disclosure. Reference will now be made in detail to implementations of the example embodiments as illustrated in the accompanying drawings. The same reference indicators will be used to the extent possible throughout the drawings and the following description to refer to the same or like items.

Figure 1:
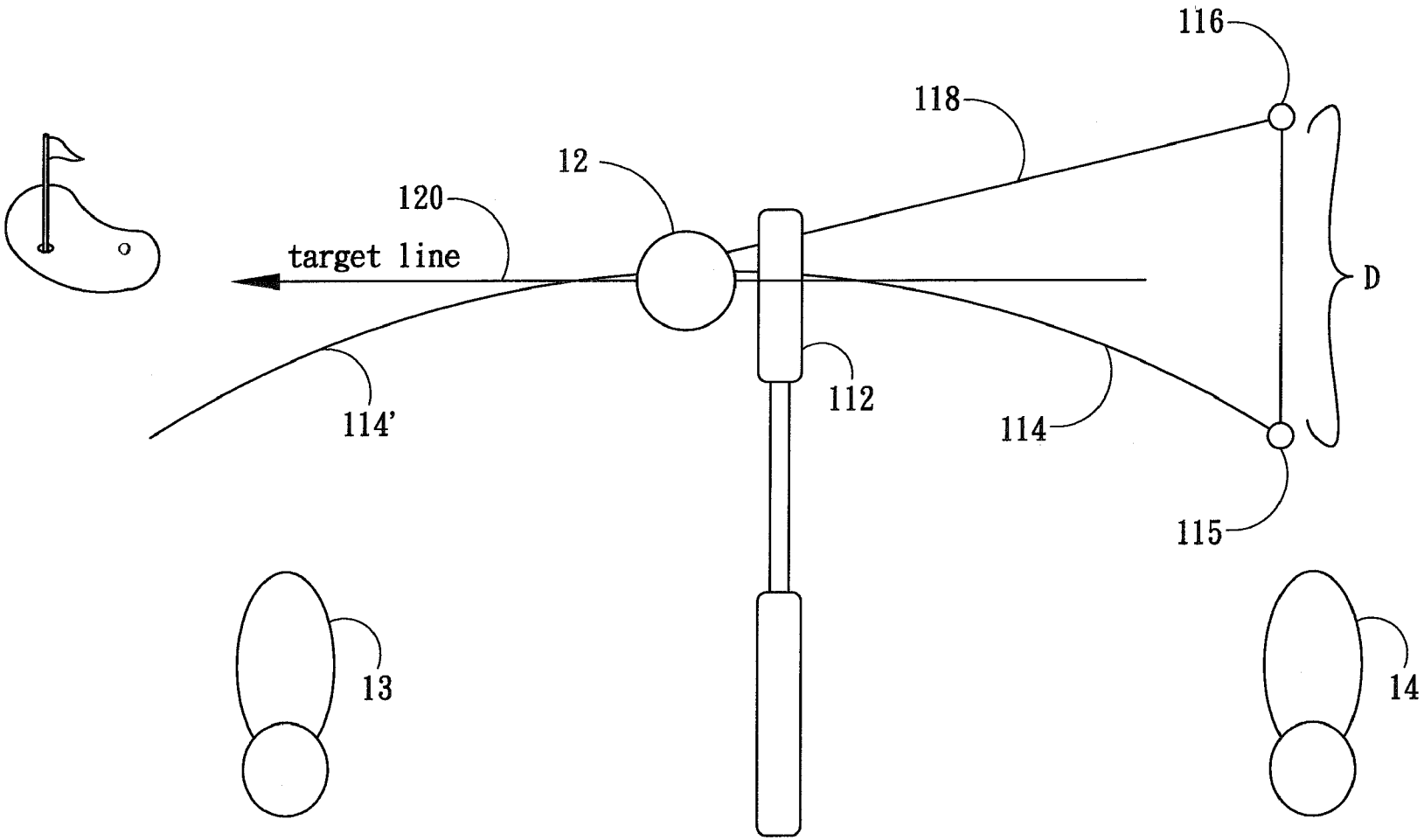
FIG. 1 is a diagram illustrating a common golf swing defect.

Referring now to FIG. 1, a diagram is shown illustrating a common swing defect to which a large proportion of golfers are prone and which the present golf swing training tool is effective in overcoming. FIG. 1 illustrates a golf ball 12 to be struck, a golf club 112, and feet 13 and 14 indicative of a golfer's stance.

In a correct swing, the golf club 112 is brought back on the backswing with the club head traveling along a path, such as along an arc 114, that brings it to a point 115. On the downswing, the club head should travel approximately along the arc 114, contact and move through the ball 12, and move along a forward arc 114' that is a continuation of the arc 114. The arc 114/114' forms an idealized swing path. In actual practice, particularly on the backswing, an acceptable golf swing may deviate to a greater or lesser degree from the swing path 114/114'. However, it is important to note that, except for the point of contact, the idealized swing path 114/114' is "inside" a target line 120—that is, on the side of the target line 120 nearest the golfer. A common mistake is that, in the transition between the backswing and the downswing, the golfer brings his or her shoulders forward in a manner that causes a displacement D of the club head from the desired point 115 of initiating the downswing to a point 116 that is "outside" the target line 120. From this beginning point 116, the golfer brings the club head forward along a path 118 to contact the ball 12 and follows through along a path that may be roughly the same as the desired follow through path 114'. Because of this displacement D of the club head between the backswing phase and the downswing phase, the golfer hits the ball 12 in an "outside-in" manner with the result that the ball 12, instead of being hit straight, is pulled, pull hooked, sliced, etc.

It has been found that by providing a direct visual prompt as to the proper club head swing path during each swing of the golf club, the present golf swing training tool assists a golfer in learning the correct swing path the club head should following during a normal golf swing, in order to consistently hit the ball in the desired direction.

Figure 2A:
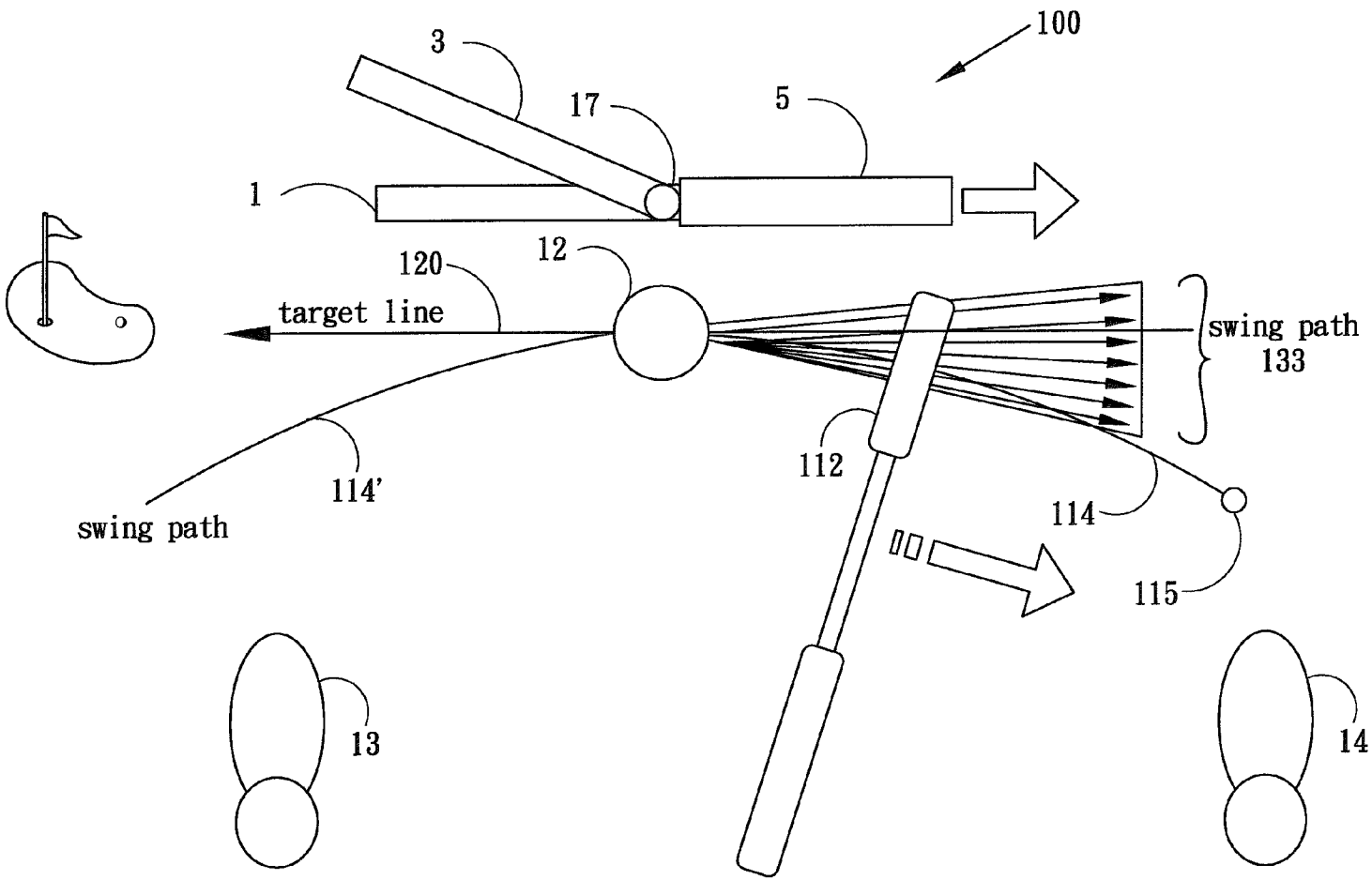
FIG. 2A is a diagram illustrating the present golf swing training tool used during a backswing phase.

Referring to FIG. 2A, the golfer places the tool 100 on the ground, for example on the far side of the golf ball 12 (allowing the golfer to hit shots off grass, as on a golf course, or off a driving range mat, or any desired surface, since no contact is made with the tool during the swing). The tool 100 is placed on the ground in the vicinity of the golf ball 12 such that, while the golfer focuses his or her vision primarily on the golf ball 12, the golfer's peripheral vision includes a view of the tool 100. The tool 100 may include a front target line member 1, a rear target line member 5, and a swing path indicator member 3 attached at a pivot point 17. When the tool 100 is placed on the ground, the front target line indicator 1 and the rear target line indicator 5 are typically aligned in a straight line, used to form the target line 120 to the golfer's intended target. This feature trains the golfer to appreciate the importance of knowing where the target line 120 is on each shot, and provides a visual reference for the golfer to line up to. Indicia may be provided on the members to distinguish the front target line member 1, the rear target line member 5, and the swing path indicator member 3. For example, the front target line member 1 may be labeled with a depiction of a flagstick, indicative of the target line; the rear target line member 5 may be labeled with the number one, indicative of the first phase, or backswing phase, of the swing; and the swing path indicator member 3 may be labeled with the number two, indicative of the second phase, or downswing phase, of the swing. Such indicia, however, are by no means required.

The tool is designed to allow the swing path indicator member 3 to rotate 360 degrees; optionally, as described in greater detail below, the swing path indicator member 3 may be arranged so as to allow it slide almost its entire length, in relation to its pivot point, so that the swing path indicator member can be placed in various useful positions to facilitate training the golfer.

As further shown in FIG. 2A, during a backswing phase the rear target line member 5 of the tool provides a visual prompt to the golfer to execute a takeaway of the club head. A swing path 133 of the club head 112 during the backswing may vary from straight back along the target line 120 to back approximately along the path of the arc 114. For some swings, the path of the club head 112 during the backswing may even be somewhat outside the target line 120. Regardless of the path of the backswing, however, in order to execute a correct downswing, in the transition between the backswing and the downswing, the golfer brings the club head within the vicinity of the desired point 115 of initiating the downswing.

Figure 2B:
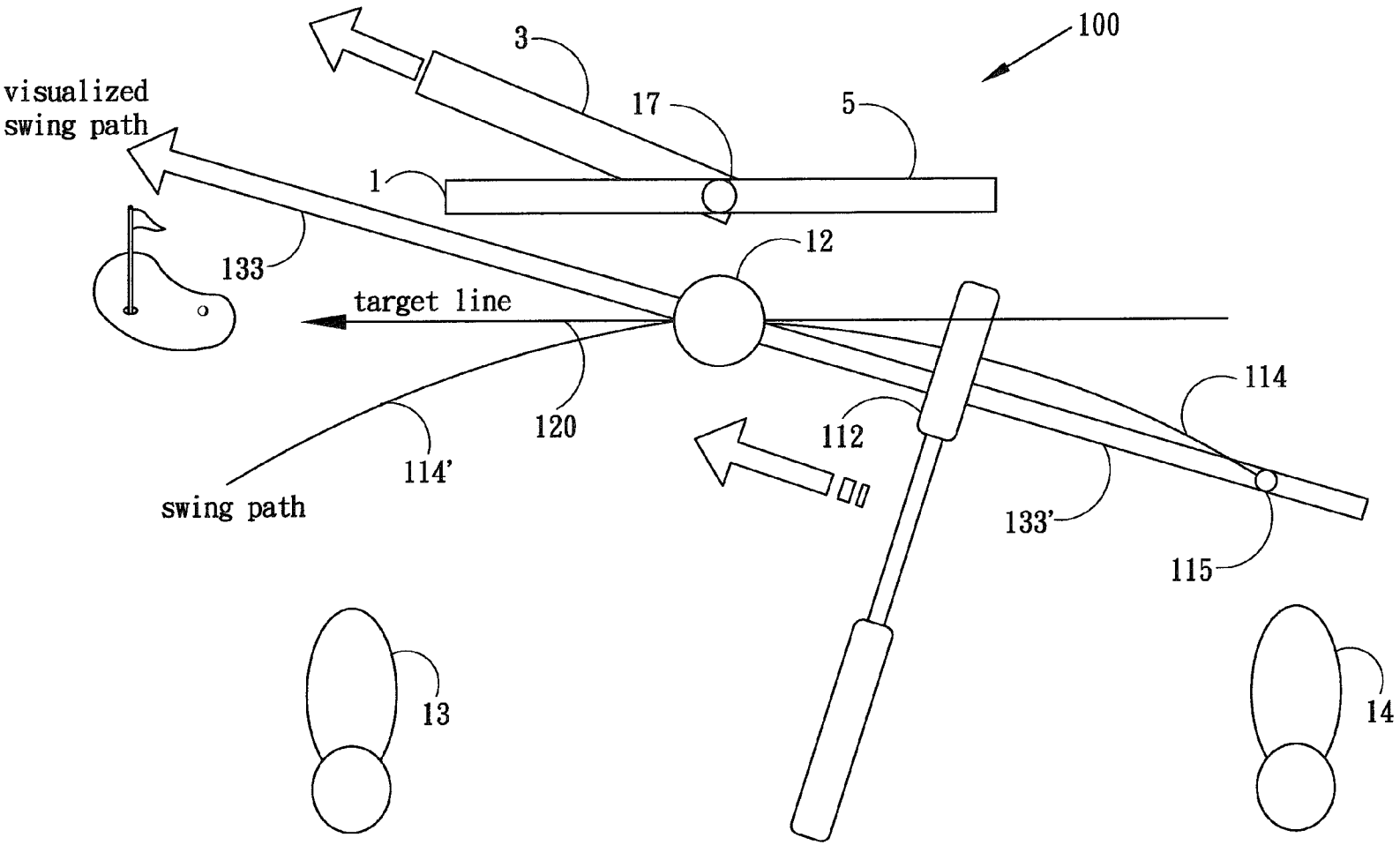
FIG. 2B is a diagram illustrating the present golf swing training tool used during a downswing phase.

Referring to FIG. 2B, during a downswing phase the swing path indicator member 3 provides a visual prompt to the golfer to hit through the ball in an inside-out path, along a visualized swing path 133'. The club head does not actually travel along this path. However, this mental image causes the golfer to executed the motions needed to cause the club head to move approximately along the desired swing path 114/114'.

Figure 3:
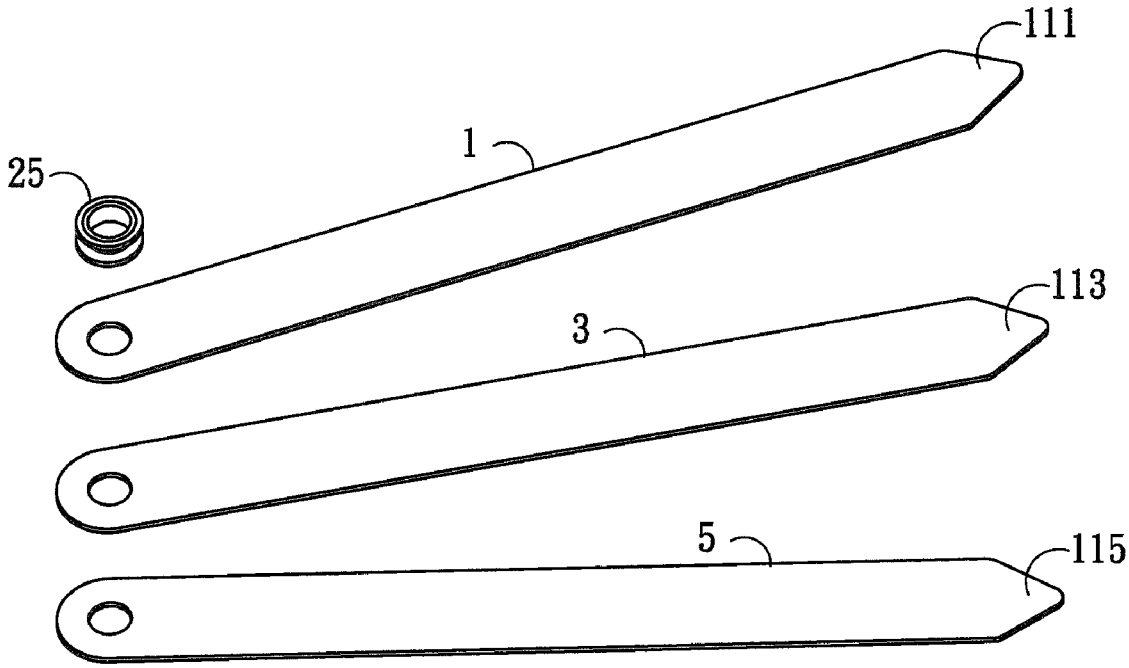
FIG. 3 is a diagram illustrating details of one embodiment of the present golf swing training tool.

FIG. 3 illustrates in greater detail the three members 1, 3 and 5 making up the tool in one embodiment thereof. The three members 1, 3 and 5, which can be hinged, swiveled or snapped together, or connected in any of various other well-known ways, extend to form the desired length required by the golfer. Ends of the three members 1, 3 and 5, (together "pointing members"), may have tapered ends 111, 113 and 115, respectively. In the illustrated embodiment, the three pointing members 1, 3 and 5 are secured by a grommet 25, although the pointing members 1, 3, 5 may be secured by any of various known devices. Optionally, as shown in greater detail in FIG. 7, embossings 30 may be formed on the pointing members 1, 3 and 5 in an area adjoining an axis of rotation, providing tactile feedback to a user concerning a degree of rotation between the first pointing members and holding the pointing members in place. Positive embossings may be formed on one side of each of the pointing members 1, 3, 5, and matching negative embossings may be formed on an opposite side of each of the pointing members 1, 3, 5 such that the positive and negative embossings engage.

The pointing members 1, 3, 5 will typically be straight but not necessarily so. For example, in some instances, it may be desirable for the swing path indicator member 3 to be slightly curved away from the visualized swing path 133' and slightly toward the actual swing path 114'.

The use of a grommet 25 to attach together the pointing members 1, 3 and 5 allows the golfer, in some instances, to hit the ball off a tee inserted through the grommet 25. Such a configuration may be useful in some instances but is not ordinarily preferred because of the possibility of the student golfer hitting the golf training tool.

In an exemplary embodiment, the pointing members 1, 3 and 5 are made of plastic and are approximately 12 inches long, 1.25 inches wide and 0.03 inches thick. Of course, these dimensions are exemplary only and may be varied within a wide range. Instead of plastic, the pointing members 1, 3 and 5 may be made of wood, metal, composite, or any other suitable material.

Figure 7:
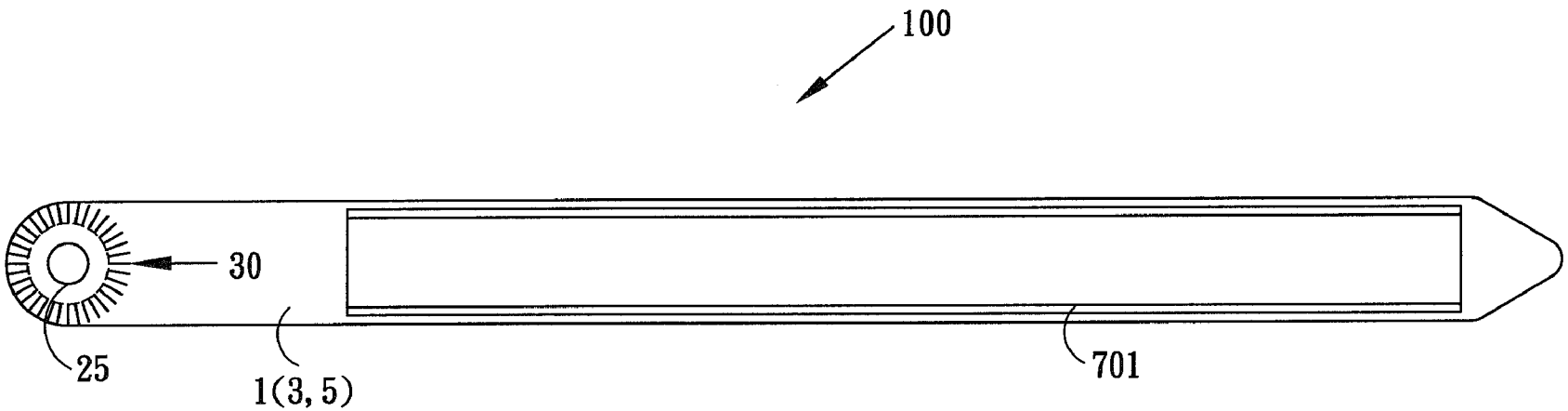
FIG. 7 is a diagram illustrating an embodiment of the present golf swing training tool featuring embossings.

As seen in FIG. 7, in a stowed position, the pointing members 1, 3, 5 overlie one another. In this condition, the present golf training tool 100 is very compact and convenient to carry. Because it is small and inexpensive, and because it provides surfaces (e.g., area 701 of FIG. 7) on which promotional material may be printed or adhered, the golf training tool 100 makes an attractive promotional item.

Figure 4:
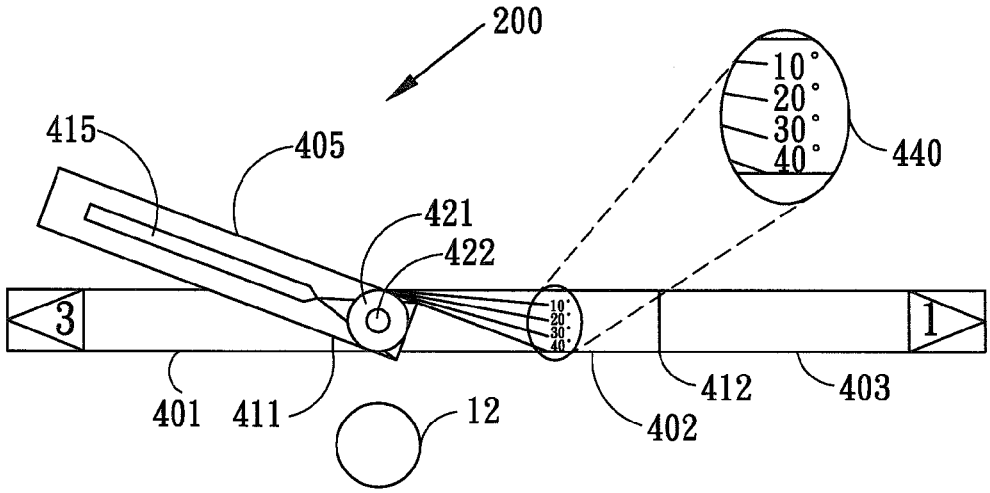
FIG. 4 is a diagram illustrating another embodiment of the present golf swing training tool in one configuration thereof.
Figure 5:
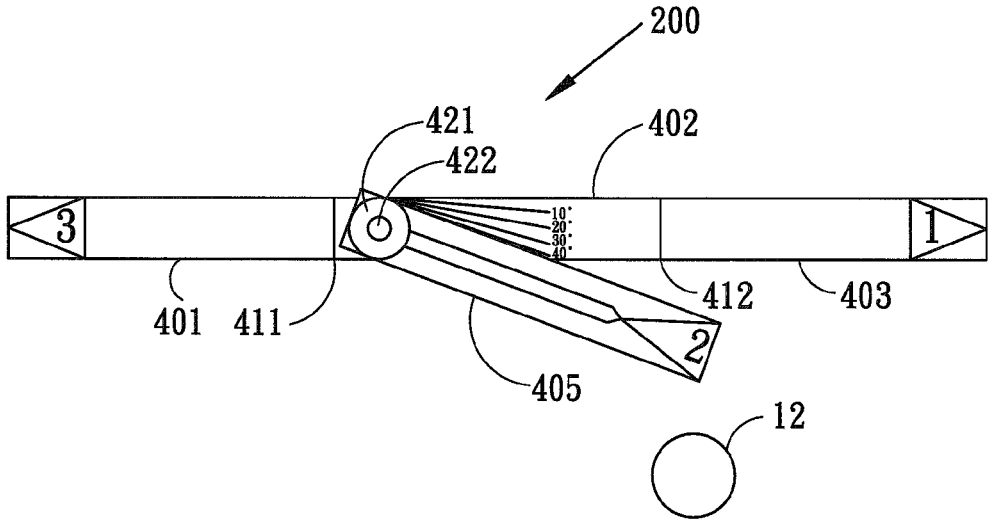
FIG. 5 is a diagram illustrating an embodiment of the present golf swing training tool in another configuration thereof.
Figure 6:
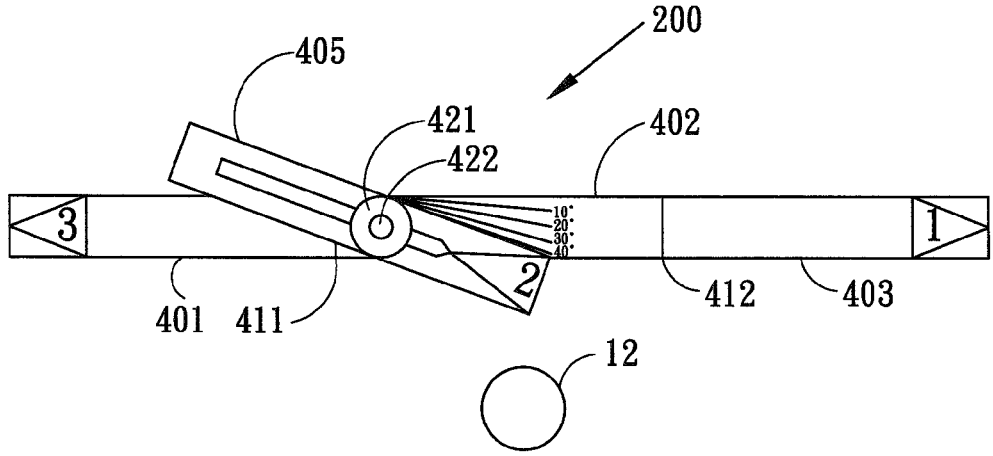
FIG. 6 is a diagram illustrating an embodiment of the present golf swing training tool in still another configuration thereof.

Another embodiment of the invention is illustrated in FIGS. 4-6. Referring to FIG. 4, in this embodiment, the main body of the tool 200 is made up of three members including a front target line member 401, a middle target line member 402, and a rear target line member 403, which can be hinged, swiveled or snapped together, or connected in any of various other well-known ways, to form the desired length required by the golfer. In the illustrated embodiment, hinges 411, 412 are used to join the target line members. A swing path indicator member 405 is attached by a thumbscrew 421 or by other suitable means. A swing path indicator angle gauge 440 may be provided.

The swing path indicator member 405 may be slotted (slot 415) so that it may be positioned in any of a wide variety of positions. In FIG. 4, the swing path indicator member 405 is positioned with an axis of rotation roughly even with the ball 12 and the swing path indicator member 405 extending toward the outside of the target line members (401, 402, 403). In FIG. 5, the swing path indicator member 405 is positioned with an axis of rotation 422 forward of the ball 12 and the swing path indicator member 405 extending toward the inside of the target line members (401, 402, 403). In FIG. 6, the swing path indicator member 405 is positioned with an axis of rotation 422 forward of the ball 12 by a lesser amount and the swing path indicator member 405 extending on both sides of the target line members (401, 402, 403).

The golf swing training tool (100, 200) may be used in a golf swing training method by placing a first pointing member 1 on a hitting surface in proximity to a golf ball, the first pointing member 1 pointing in the direction of a line from the golf ball to a target; and placing a second pointing member 3 on the hitting surface in proximity to the golf ball, the second pointing member 3 pointing along a line angled in relation to the target line. The second pointing member presents a visual prompt to a user to encourage a desired path of a golf club head and to counter a tendency toward an undesirable path of the golf club head. A user then strikes the golf ball while receiving visual prompts from the first pointing member and the second pointing member.

Tools of various other constructions than those described may be used, including tools having fixed members and tools having adjustable members. A simple angle indicator may be used, for example. The angle indicator is placed on a hitting surface in proximity to a golf ball such that the angle indicator indicates to a user an angle between i) a target line from the golf ball to a target and ii) a line angled in relation to the target line. The line angled in relation to the target line presents a visual prompt to a user to encourage a desired path of a golf club head and to counter a tendency toward an undesirable path of the golf club head. The user then strikes the golf ball while receiving visual prompts from the angle indicator.

While embodiments and applications have been shown and described, it would be apparent to those skilled in the art of having the benefit of this disclosure that many more modifications than mentioned above are possible without departing from the inventive concepts disclosed herein. The invention, therefore, is not to be restricted except in the spirit of the appended claims.

What is claimed is:

1. A golf swing training tool comprising:

a first elongated pointing member for pointing in a direction of a target line from a golf ball to a target;

a second elongated pointing member rotatably coupled to the first pointing member and adapted for-pointing at an acute angle in relation to the first member, the second pointing member presenting a visual prompt to a user to encourage a desired path of a golf club head and to counter a tendency toward an undesirable path of the golf club head; and a third pointing member rotatably coupled to the first pointing member adapted for pointing in a backward direction opposite of the first member;

wherein each of the first, second and third pointing members are made of flexible plastic, are about twelve inches or more in length, and have end portions that are tapered or narrowed so as to point in a lengthwise direction of the member.

2. The golf swing training tool of claim 1, comprising embossings formed on the first elongated pointing member and the second elongated pointing member in an area adjoining an axis of rotation, providing tactile feedback to a user concerning a degree of rotation between the first elongated pointing member and the second elongated pointing member and holding the first elongated pointing member and the second elongated pointing member in place.

3. The golf swing training tool of claim 1, wherein the second elongated pointing member is slidably coupled to the first elongated pointing member.

4. The golf swing training tool of claim 1, wherein the first elongated pointing member and the second elongated pointing member have a stowed position in which the first elongated pointing member and second elongated pointing member are overlaid one on top of one another.

5. The golf swing training tool of claim 1, wherein the first elongated pointing member and the second elongated pointing member are formed of plastic.

6. The golf swing training tool of claim 1, wherein the first elongated pointing member and the second elongated pointing member have dimensions within a range +100% and −50% of the following: width 1.25 inches.

7. The golf swing training tool of claim 1, wherein the first elongated pointing member and the second elongated pointing member have dimensions within a range +1000% and −50% of the following: thickness 0.03 inches.

8. The golf swing training tool of claim 1, wherein the first elongated pointing member, the second elongated pointing member, and the third elongated pointing member have a stowed position in which the first elongated pointing member, the second elongated pointing member and the third elongated pointing member are all overlaid one on top of one another.

9. The golf swing training tool of claim 1, wherein the first elongated pointing member and the second elongated pointing member are attached by a rivet or grommet.

10. A method of golf swing training, comprising:

placing on a hitting surface in proximity to a golf ball a first elongated pointing member pointing in a direction of a target line from the golf ball to a target;

placing and rotating a second elongated pointing member to point at an acute angle in relation to the target line, the second pointing member presenting a visual prompt to a user to encourage a desired path of a golf club head and to counter a tendency toward an undesirable path of the golf club head;

placing on the hitting surface and rotating a third elongated pointing member pointing in a backward direction opposite of the target line; and a user striking the golf ball while receiving visual prompts from the first elongated pointing member and the second elongated pointing member.

11. The method of claim 10, wherein embossings are formed on the first elongated pointing member and the second elongated pointing member in an area adjoining an axis of rotation, providing tactile feedback to a user concerning a degree of rotation between the first elongated pointing member and the second elongated pointing member and holding the first elongated pointing member and the second elongated pointing member in place.

12. The method of claim 10, wherein the second elongated pointing member is slidably coupled to the first elongated pointing member.

13. The method of claim 10, wherein the first elongated pointing member and the second elongated pointing member have tapered tips.

14. The method of claim 10, further comprising overlaying the members one on top of another for stowing.

15. The method of claim 10, wherein the first elongated pointing member and the second elongated pointing member are formed of plastic.

16. The method of claim 10, wherein the first elongated pointing member and the second elongated pointing member have dimensions within a range +100% and −50% of the following: length 12 inches; width 1.25 inches.

17. The method of claim 10, wherein the first elongated pointing member and the second elongated pointing member have dimensions within a range +1000% and −50% of the following: thickness 0.03 inches.

18. The method of claim 10, wherein the first elongated pointing member and the second elongated pointing member are attached by a rivet or grommet.

19. A golf swing training tool comprising:

a first elongated pointing member for pointing in a direction of a target line from a golf ball to a target;

a second elongated pointing member rotatably coupled to the first pointing member and adapted for-pointing at an acute angle in relation to the first member, the second pointing member presenting a visual prompt to a user to encourage a desired path of a golf club head and to counter a tendency toward an undesirable path of the golf club head; and a third pointing member rotatably coupled to the first pointing member adapted for pointing in a backward direction opposite of the first member;

an angle indicator provided on one of the pointing members showing indications for a plurality of acute angles for positioning two of the pointing members at a desired acute angle with respect to each other.

20. The golf swing training tool of claim 19, comprising embossings formed on the first elongated pointing member and the second elongated pointing member in an area adjoining an axis of rotation, providing tactile feedback to a user concerning a degree of rotation between the first elongated pointing member and the second elongated pointing member and holding the first elongated pointing member and the second elongated pointing member in place.

21. The golf swing training tool of claim 19, wherein the second elongated pointing member is slidably coupled to the first elongated pointing member.

22. The golf swing training tool of claim 19, wherein the first elongated pointing member and the second elongated pointing member have a stowed position in which the first elongated pointing member and second elongated pointing member are overlaid one on top of one another.

23. The golf swing training tool of claim 19, wherein the first elongated pointing member and the second elongated pointing member are formed of plastic.

24. The golf swing training tool of claim 19, wherein the first elongated pointing member and the second elongated pointing member have dimensions within a range +100% and −50% of the following: length 12 inches; width 1.25 inches.

25. The golf swing training tool of claim 19, wherein the first elongated pointing member and the second elongated pointing member have dimensions within a range +1000% and −50% of the following: thickness 0.03 inches.

26. The golf swing training tool of claim 19, wherein the first elongated pointing member, the second elongated pointing member, and the third elongated pointing member have a stowed position in which the first elongated pointing member, the second elongated pointing member and the third elongated pointing member are all overlaid one on top of one another.

27. The golf swing training tool of claim 19, wherein the first elongated pointing member and the second elongated pointing member are attached by a rivet or grommet.

* * * * *